US009840877B2

(12) United States Patent
Blackmon

(10) Patent No.: US 9,840,877 B2
(45) Date of Patent: Dec. 12, 2017

(54) DOWNHOLE PROTECTION APPARATUS

(71) Applicant: Tendeka B.V., Altens, Aberdeen (GB)

(72) Inventor: Chris Blackmon, Houston, TX (US)

(73) Assignee: Tendeka B.V., Altens, Aberdeen (GB)

( * ) Notice: Subject to any disclaimer, the term of this patent is extended or adjusted under 35 U.S.C. 154(b) by 0 days.

(21) Appl. No.: 14/782,485

(22) PCT Filed: May 2, 2014

(86) PCT No.: PCT/US2014/036588
§ 371 (c)(1),
(2) Date: Oct. 5, 2015

(87) PCT Pub. No.: WO2014/179696
PCT Pub. Date: Nov. 6, 2014

(65) Prior Publication Data

US 2016/0069141 A1 Mar. 10, 2016

(30) Foreign Application Priority Data

May 3, 2013 (GB) ..... 1308047.8

(51) Int. Cl.
*E21B 17/00* (2006.01)
*E21B 17/10* (2006.01)
(Continued)

(52) U.S. Cl.
CPC ..... *E21B 17/006* (2013.01); *E21B 17/1035* (2013.01); *E21B 17/1042* (2013.01);
(Continued)

(58) Field of Classification Search
CPC . E21B 17/006; E21B 17/1035; E21B 17/1042
See application file for complete search history.

(56) References Cited

U.S. PATENT DOCUMENTS 3,844,345 A 10/1974 Evans et al.
3,933,203 A * 1/1976 Evans ..... E21B 17/1014 166/241.6
(Continued)

FOREIGN PATENT DOCUMENTS

EP 2184437 A2 5/2010
GB 2044320 A 10/1980

OTHER PUBLICATIONS

International Search Report PCT/ISA/210 for International Application No. PCT/US2014/036588 dated Jan. 25, 2015.
(Continued)

*Primary Examiner* — Matthew R Buck
*Assistant Examiner* — Aaron L Lembo
(74) *Attorney, Agent, or Firm* — Harness, Dickey & Pierce, P.L.C.

(57) ABSTRACT

A downhole protection apparatus, for use in protecting downhole control lines, comprises a sheath defining a channel configured to receive a control line. The sheath is configured to be attached to a tubing. In wellbore applications, the control lines associated with a tubing are inserted into the sheath such that the body of the sheath at least partially encompasses the control line and shields the control line from harsh downhole conditions which may include abrasive action from sand, proppants, wellbore cuttings and other debris. Therefore, the apparatus is configured such that after insertion of a control line into the channel, a body of the sheath protects the control line from an outside environment.

33 Claims, 3 Drawing Sheets

(51) Int. Cl.

| | |
|---|---|
| ***E21B 17/20*** | (2006.01) |
| ***E21B 19/22*** | (2006.01) |
| ***E21B 47/01*** | (2012.01) |
| ***E21B 19/00*** | (2006.01) |

(52) U.S. Cl.
CPC ..... *E21B 17/206* (2013.01); *E21B 19/00* (2013.01); *E21B 19/22* (2013.01); *E21B 47/01* (2013.01)

(56) References Cited

U.S. PATENT DOCUMENTS

| | | | | | |
|---|---|---|---|---|---|
| 4,203,186 | A | | 5/1980 | Horner | |
| 4,262,703 | A | * | 4/1981 | Moore | H01B 7/0072 138/111 |
| 4,337,969 | A | * | 7/1982 | Escaron | E21B 17/026 166/65.1 |
| 4,611,656 | A | * | 9/1986 | Kendall, Jr. | E21B 17/1035 138/107 |
| 4,683,944 | A | * | 8/1987 | Curlett | E21B 17/003 166/65.1 |
| 4,740,658 | A | | 4/1988 | Hoffman et al. | |
| 5,435,387 | A | * | 7/1995 | Roberts | E21B 17/08 138/114 |
| 5,803,170 | A | * | 9/1998 | Garcia-Soule | E21B 17/1035 166/241.6 |
| 5,973,270 | A | * | 10/1999 | Keller | E21B 17/1035 174/136 |
| 6,135,209 | A | | 10/2000 | Uhlenkott | |
| 6,302,213 | B1 | | 10/2001 | Uhlenkott | |
| 6,932,161 | B2 | * | 8/2005 | Cameron | E21B 17/1035 166/206 |
| 8,727,024 | B2 | * | 5/2014 | Decker | E21B 19/00 166/385 |
| 8,752,633 | B2 | * | 6/2014 | Whitelaw | E21B 17/1035 138/110 |
| 9,303,478 | B2 | * | 4/2016 | Scruggs | E21B 47/12 |
| 2002/0014337 | A1 | | 2/2002 | Uhlenkott | |
| 2003/0015324 | A1 | | 1/2003 | Uhlenkott | |
| 2003/0192706 | A1 | | 10/2003 | Uhlenkott | |
| 2005/0039924 | A1 | | 2/2005 | Uhlenkott | |
| 2006/0065405 | A1 | | 3/2006 | Uhlenkott | |
| 2010/0236779 | A1 | | 9/2010 | Nutley et al. | |
| 2011/0315391 | A1 | | 12/2011 | McD. Cameron | |

OTHER PUBLICATIONS

Written Opinion of the International Searching Authority PCT/ISA/237 for International Application No. PCT/US2014/036588 dated Jan. 25, 2015.

* cited by examiner

DOWNHOLE PROTECTION APPARATUS

CROSS-REFERENCE TO RELATED APPLICATIONS

This is a National Phase of PCT/US2014/036588, filed on May 2, 2014 and claims priority under 35 U.S.C. §119 to, United Kingdom Application No. GB 1308047.8 filed May 3, 2013, the entire contents of each of which are incorporated herein by reference in their entirety.

BACKGROUND TO THE INVENTION

Typically in wellbore applications, strings of tubing are deployed into an oil well in combination with control lines in order to facilitate the operation of equipment downhole. Examples of such control lines include optical fibres, umbilical cables and tubing encapsulated conductor (TEC) cables. These control lines are usually held in position on the strings of tubing by clamps.

Downhole conditions can be fierce and assemblies for use downhole can be subjected to extreme temperatures and pressures and also exposed to highly abrasive solid particles, such as sand, proppants, wellbore cuttings and other debris. For example, during fracturing operations, highly abrasive materials (such as proppants and sand) are pumped downhole at high rates. Such extreme conditions can result in damage to the exposed control lines and, consequently, can decrease the operational life of the well.

SUMMARY OF THE INVENTION

According to a first aspect of the invention there is provided a downhole protection apparatus for use in protecting downhole control lines, comprising a sheath defining a channel configured to receive a control line.

In use, the sheath may be configured to be attached to a tubing. In wellbore applications, the control lines associated with a tubing may be inserted into the sheath such that the body of the sheath at least partially encompasses the control line and shields the control line from harsh downhole conditions which may include abrasive action from sand, proppants, wellbore cuttings and other debris. In use, the apparatus may be configured such that after insertion of a control line into the channel, a body of the sheath protects the control line from an outside environment. For instance, during a fracturing operation, where highly abrasive materials may be pumped downhole at high pressures, the sheath may protect the control lines held on the outside of a tubing from abrasive damage.

As used herein "outside environment" may refer to an environment external to a tubing string, such as an environment in an annulus between the tubing string and a wall of an outer bore.

As used herein "a tubing" may refer to a tubular member or section of a tubular member for use in wellbore applications. A tubing may refer to a single pipe or multiple pipes attached end-to-end to form a tubing string.

The sheath may comprise or be formed of a resilient and/or an elastic material, such as rubber, e.g. synthetic rubber or natural rubber.

The sheath may protect and/or shield a control line from impact forces, pressure pulses, pressure variations, shock loads and/or collisions, e.g. collisions with external surfaces, collisions with a surface of the wellbore or casing or collisions with other control lines.

The sheath may comprise or be formed of a shock-absorbant material. The sheath may comprise a physical and/or mechanical structure that acts to absorb shock. For instance, the sheath may comprise a lattice, porous or honeycomb-like structure and/or may be inflatable.

The sheath may act as a shock-absorber. For example, the sheath may absorb shock loads downhole, for example, shock loads exerted by perforation guns and the like.

The sheath may provide a physical barrier. For example, the sheath may shield a control line from abrasive materials, such as sand, proppants and the like.

The sheath may comprise a swellable or non-swellable material. The material may be swellable in oil and/or water.

The sheath may be in the form of an elongate element. The sheath may be in the form of a rib configured to extend longitudinally along a length of tubing. The surface profile of the sheath may be configured to engage with the outer surface of a tubing, e.g. the sheath may have a substantially arcuate surface profile.

The sheath may be storable in a rolled form. The sheath may be supplied in a rolled form for ease of installation onto a tubing. For example, the sheath may be supplied on a reel or drum.

The sheath may define at least one channel or a plurality of channels. For example, the sheath may define two, three or four channels. In such embodiments, the channels may be parallel to one another. The channel or the plurality of channels may extend along the same axial direction as the sheath.

At least one channel may be configured to hold a single control line or a plurality of control lines. Each channel may be independently configured to hold a single control line or a plurality of control lines.

At least one channel may be in the form of a slot and may be coterminous with the sheath. For example, at least one channel may be a continuous slot extending along the length of the sheath. The slot may comprise an entrance portion which extends into an enlarged head portion configured to house a control line.

The channel may be configured such that a control line may be push-fit or slidingly installed into the channel. The sheath may be configured such that the channel comprises a variable dimension. The channel may comprise a hinged opening to allow installation of a control line into the channel. The structure of the sheath may permit movement of relative parts to facilitate installation of a control line into the channel. The body of the sheath may be configured to completely surround a control line after insertion into the channel.

The material defining the channel may be resiliently and/or elastically deformable. In use, after insertion of a control line into the channel and attachment of the sheath to a tubing, compressive forces may compress a channel entrance, sealing the control line within the body of the sheath.

The apparatus may further comprise an outer cover. The outer cover may extend continuously or discontinuously along the length of the sheath, or may provide discrete coverage along the length of the sheath, for example, the outer cover may comprise a plurality of bodies configured to engage the sheath at discrete points along the length of the sheath. The outer cover may be configured to be mounted onto the sheath and/or may comprise a cooperating profile to that of an outer surface of the sheath.

The outer cover may be permanently attached or removably attachable to the sheath. Upon attachment to the sheath, the outer cover may exert a compressive force onto the sheath to effectively close the channel entrance and seal a control line within the body of the sheath.

The outer cover may be formed of a rigid material, such as a metallic or plastics material. The outer cover may shield the sheath from an outside environment and/or may provide a physical barrier to the outside environment.

The sheath may be directly attachable to an outer surface of a tubing, e.g. by adhesion, fusing, welding, vulcanization, interference, a cooperating profile or the like. The sheath or outer cover may be configured to be circumscribed by a clamping member holding the sheath or outer cover in position on a tubing string.

The sheath may be attachable to a tubing on one or more faces of the sheath. The sheath may be attachable to an outer surface of a tubing such that the entrance of the channel contacts the outer surface of the tubing. In such embodiments, a control line may be inserted into the at least one channel prior to attachment of the sheath on the tubing. The sheath may be attachable on an outer surface of a tubing such that the entrance of the at least one channel opens to an outside environment.

The outer cover and/or the sheath may be attachable or mountable to a clamping member, for example, via a snap-fit mechanism and/or by adhesion, welding, fusing, vulcanization, interference, cooperating profiles or the like. The outer cover and/or sheath may be mountable to an outer surface of a clamping member. The outer cover and/or sheath may be mountable to an outer surface of a plurality of clamping members, each of the clamping members at a discrete position along the length of the outer cover and/or sheath. The outer cover may be formed integrally with the clamping member. The outer cover may comprise a hinged member.

According to a second aspect of the invention there is provided a downhole assembly comprising:

a tubing, a downhole protection apparatus mounted along a length of the tubing and comprising a sheath defining a channel, and a control line inserted into the channel.

In use, the assembly may be configured such that a body of the sheath protects the control line from an outside environment when the downhole protection apparatus is mounted on the tubing.

The downhole protection apparatus may comprise an outer cover. The outer cover may be mounted and/or engage with the outer surface of the sheath. The outer cover may act as a shield to protect the inner sheath.

The downhole assembly may comprise a clamping member or a plurality of clamping members. At least one clamping member may attach the downhole protection apparatus to the tubing and/or hold the downhole protection apparatus in position relative to the tubing. The clamping members may be positioned at discrete points along the length of the tubing.

The outer cover and/or sheath may be circumscribed by the clamping member. The outer cover and/or sheath may be configured to mount onto the clamping member. The outer cover and/or sheath may be mountable onto an outer surface of a clamping member at discrete points along the length of a tubing. The outer cover may be formed integrally with the clamping member.

The tubing may be formed of any tubular member for use in a wellbore. The tubing may be a pipe, a section of pipe or a plurality of pipes attached end-to-end to form a tubing string. For example, the tubing may comprise production tubing, blast joint tubing or the like.

According to a third aspect of the invention there is provided a method for preparing a tubing for a downhole assembly comprising:

mounting a downhole protection apparatus comprising a sheath to a tubing, installing a control line into a channel defined by the sheath.

After installation, e.g. by insertion or the like, of the control line into the channel, a body of the sheath may protect the control line from an outside environment.

The method may comprise installing the control line before or after the mounting step, or the two steps may be carried out contemporaneously.

The method may comprise attaching an end of the tubing to an end of another tubing to form a tubing string.

The downhole protection apparatus may be provided in a form to facilitate mounting of the downhole protection apparatus onto the tubing. For example, the downhole protection apparatus may be stored and/or supplied in rolled form, such as wound around a reel or drum or may be provided in the form of discrete elongate sections which can be stacked, for example in pallets or the like. The provision of the downhole protection apparatus in such forms may allow the downhole protection apparatus to be compactly stored and transported.

The method may comprise mounting the downhole protection apparatus from a rolled form, such from a reel, onto the tubing. In use, the downhole protection apparatus may be unrolled and/or unwound from the reel and mounted onto the tubing, e.g. mounting continuously along the tubing. Alternatively, discrete lengths of downhole protection apparatus may be cut, e.g. cut from the reel, and mounted onto the tubing. The provision of the downhole protection apparatus in a rolled form, such as on a reel, may provide a flexible method of installing the downhole protection apparatus onto the tubing, e.g. by allowing a user to cut desired and/or different lengths of downhole protection apparatus for mounting onto the tubing.

The method may comprise attaching the sheath on to the tubing. For example, by using a clamping member, or welding and/or adhering the sheath directly to the tubing or the like. For example, the sheath may be attached to the tubing by vulcanization. The method may comprise mounting the sheath to a plurality of clamping members, each of the clamping members configured to be attached at discrete points along the length of the tubing.

The method may comprise providing a sheath with an outer cover. The method may comprise mounting a downhole protection apparatus comprising a sheath and outer cover to the tubing. The method may comprise mounting the outer cover to the sheath before or after mounting the sheath the tubing. The outer cover may be clamped onto the tubing string using a clamping member or may be formed integrally with the clamping member. The outer cover may be mounted on to the clamping member, e.g. onto an outer surface of the clamping member.

The outer cover and/or the clamping member may exert a compressive force on the sheath and may compress the channel entrance to seal the control line within the body of the sheath.

According to a fourth aspect of the invention there is provided a method for installing a downhole assembly comprising:

mounting a downhole protection apparatus comprising a sheath to a tubing, installing a control line into a channel defined by the sheath, attaching an end of the tubing to an end of another tubing to form a tubing string, and running the tubing string downhole.

The method may comprise mounting the downhole protection apparatus continuously along the length of the tubing string. Alternatively, the method may comprise mounting the downhole protection apparatus discontinuously along the length of the tubing string. For example, the downhole protection apparatus may be mounted at discrete positions along the tubing string, such as in tubing sections at which high shock loads or abrasive forces are expected. For example the downhole protection apparatus may be mounted at or along sections of tubing string which will be adjacent fracturing sites once the tubing string has been run downhole or at or along sections of blast joint tubing.

According to a fifth aspect of the invention there is provided a method for protecting a control line in a downhole environment comprising:

providing a downhole protection apparatus comprising a sheath, and installing the control line into a channel defined by the sheath.

The method may comprise shielding and/or protecting the control line from damage due to the action of shock loads, pressure pulses, impact collisions and/or abrasive solid particles in downhole operations.

It will be appreciated that the features described in detail for the first, second, third, fourth and fifth aspects of the invention may be equally applied to any of the other aspects of the invention.

BRIEF DESCRIPTION OF DRAWINGS

These and other aspects of the present invention will now be described, by way of example only, with reference to the accompanying drawings, in which.

DETAILED DESCRIPTION OF THE DRAWINGS

Figure 1:
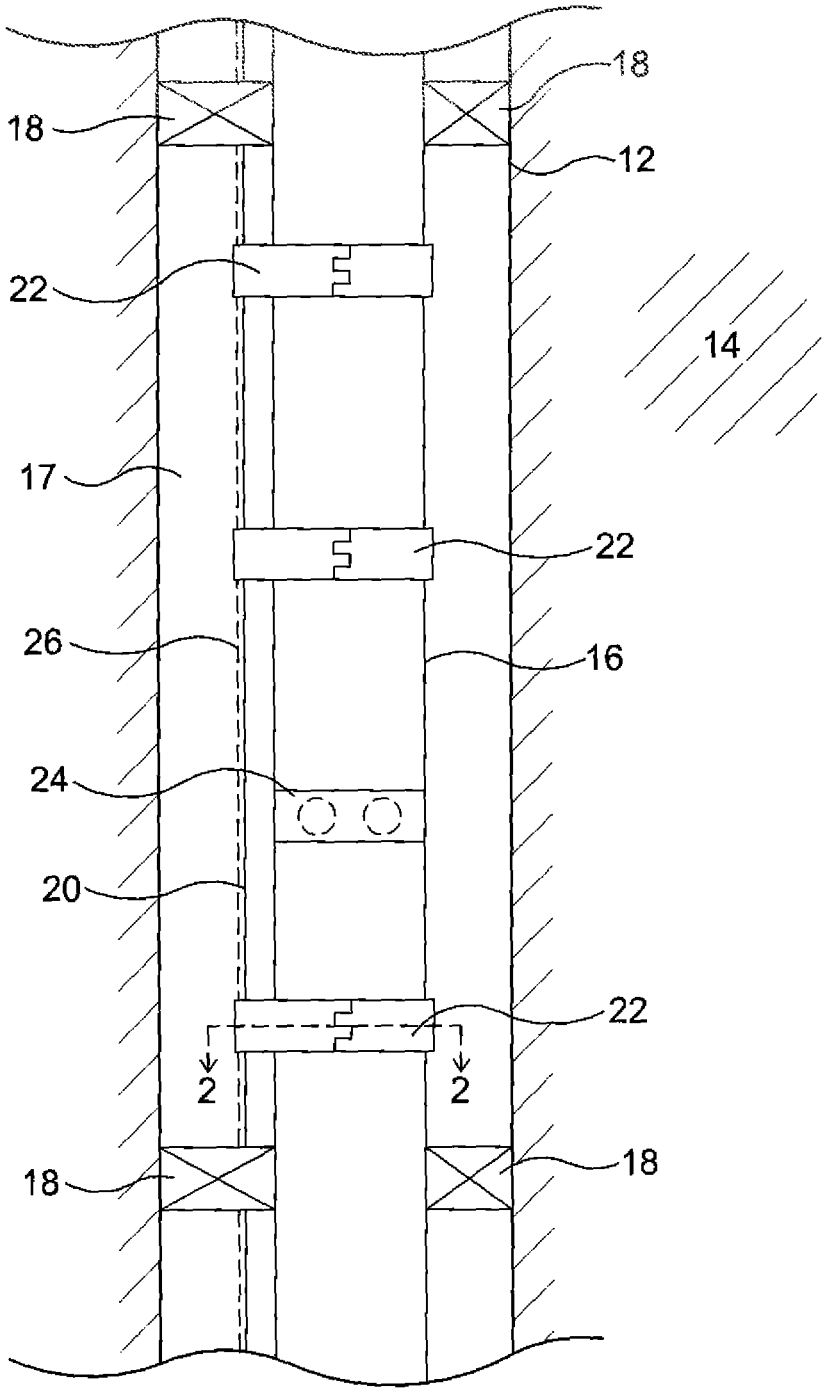
FIG. 1 illustrates a section of borehole with a tubing string extending therethrough.

In FIG. 1, a section of wellbore or borehole 12 is shown extending through a formation 14. Although, in this embodiment the invention is shown in use in an open hole application, embodiments of the invention can be used in a similar fashion in cased, lined, cemented etc. wellbore operations.

A tubing string 16, e.g. a production tubing, extends through the wellbore 12 defining an annulus 17 between the outer surface of the tubing string 16 and the wall of the wellbore 12. The tubing string 16 allows communication of fluids between the surface and the formation, for example, the tubing string 16 may facilitate communication of hydrocarbons to the surface and/or may act as a conduit to allow injection of fluids, such as fracturing fluids, from surface.

Pairs of packers 18 are positioned in the annulus 17 between the wellbore 12 and the tubing string 16. The packers 18 isolate different zones of the annulus 17 from one another and allow selective downhole operations, such as production, injection, fracturing or the like, from different zones along the wellbore.

Bundles of control lines 20 are associated with the tubing string 16 and enable surface control of downhole tools and apparatus at different locations along the wellbore 12. For example, control lines may enable communication between the surface and downhole locations, and/or may enable the transmission of control signals and/or power to downhole tools and apparatus. The bundles of control lines 20 are held in a downhole protection apparatus 26 according to an embodiment of the invention, which is shown in more detail in FIGS. 2 and 3. The downhole protection apparatus and control lines are held to the tubing string 12 by several clamps 22 which are positioned at discrete positions along the tubing string 12.

The section of tubing string 16 comprises controllable ports 24, e.g. fracturing and/or inflow ports. In fracturing operations, the ports 24 are opened and fracturing fluids are pumped downhole through the ports to the formation 14 via the annulus 17 at high pressures. Fracturing fluids are highly abrasive, containing large quantities of proppants and sand. In addition, in some wellbore applications, such as cased or lined hole applications, perforation guns can be used to perforate the borehole 12 to facilitate production. The action of perforating can mean that control lines held in the annulus are subjected to high shock loads. Consequently, it is clear that conditions in the annulus 17 can be fierce and hostile to the control lines 20 held on the outside of the tubing string 12.

The downhole protection apparatus of the invention comprises a sheath 30 to shield the bundles of control lines 20 from the fierce conditions that they would otherwise be exposed to in the annulus 17. Therefore, protection of the control lines 20 using embodiments of the invention can effectively extend the operational life of the wellbore.

Figure 2:
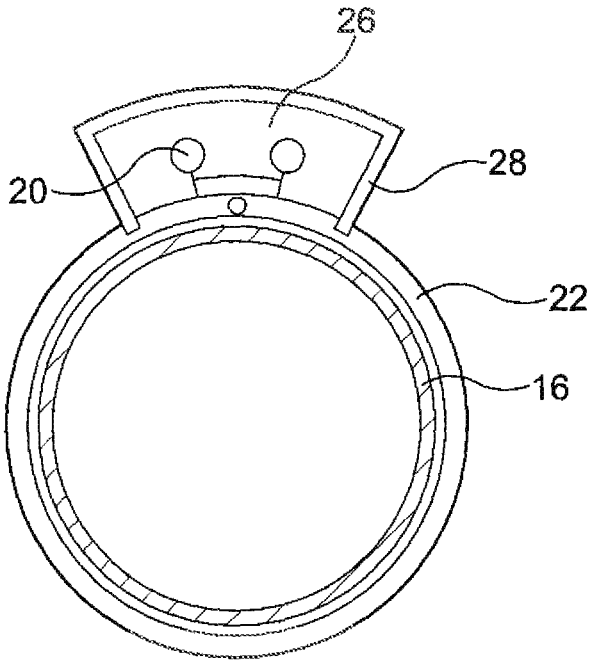
FIG. 2 is a cross-sectional view of a downhole protection apparatus according to an embodiment of the invention, shown in use mounted on a section of tubing.
Figure 3:
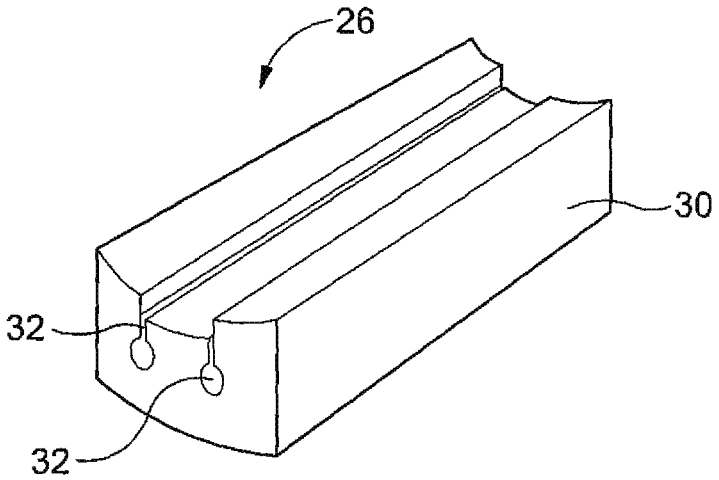
FIG. 3 is a perspective view of a downhole protection apparatus in accordance with an embodiment of the present invention.

As shown in FIGS. 2 and 3, the downhole protection apparatus 26 comprises a sheath 30 defining two channels 32 which are each independently configured to receive a control line or a bundle of control lines 20.

In the embodiment shown in FIG. 2, a hinged clamp 22 circumscribes the tubing string 16. The sheath 30 is positioned over the clamp 22 and is held in position by an outer cover 28 mounted to the sheath. The outer cover 28 extends continuously along the length of the sheath 30 and, in this embodiment, the outer cover 28 is configured to engage with the clamp 22 via an interference fit mechanism. In other embodiments, the outer cover 28 may be attached to the clamp 22 by adhesion, fusing, welding, vulcanization, a cooperating profile or the like.

In other embodiments of the invention, the clamp 22 circumscribes the sheath 30 and outer cover 28 and in this way clamps or grips the downhole protection apparatus 26 to the tubing string 16. In further embodiments, the outer cover 28 is formed integrally with the clamp 22. In addition, in some embodiments, the outer cover 28 is hinged to allow ease of installation onto the sheath 30.

The sheath 30 is an elongate body defining two channels 32 which are each independently configured to receive a control line or a bundle of control lines 20. In the embodiment shown in FIG. 3, each channel 32 is configured to receive a bundle of control lines, e.g. two or more control lines. However, in other embodiments, each channel is configured to receive only one control line 20. In further embodiments, the channels 32 are sized differently from one another such that each channel 32 is configured to receive different numbers of control lines 20 or control lines 20 of different sized diameter.

The sheath 30 is made of a resilient and elastic material, such as rubber, e.g. synthetic rubber or natural rubber. The sheath 30 is made of a shock absorbant material. In the embodiment shown in FIGS. 2 and 3, the sheath 30 protects the control line 20 from impact forces, collisions, shock loads and the like. As will be appreciated, in other embodiments, the sheath 30 can comprise a physical and/or mechanical structure that acts to absorb shock, e.g. a lattice, honeycomb-like or porous structure.

The sheath 30 is in the form of a longitudinal rib configured to extend along a length of tubing string 16. The sheath 30 is profiled on at least one face to engage with the surface of the clamp 22. In other embodiments, the sheath 30 is profiled on at least one face to engage with the surface of the tubing string 16. Another face of the sheath 30 is profiled to engage with the outer cover 28, when present in the apparatus.

Although in the illustrated embodiment, the sheath 30 comprises two channels 32, it will be appreciated that the sheath may comprise one channel or any number of channels greater than one.

The channels 32 are parallel to one another and extend along the same axial direction as the sheath 30. The channels 32 are in the form of a continuous slot extending along the length of the sheath. The slots comprise an entrance portion which extends into an enlarged head portion which is configured to house the control lines 20.

The sheath 30 is configured such that after insertion of the control lines 20 into the channels 32, the elasticity and/or resiliency of the sheath body effectively seals the control lines within the body of the sheath 30. In use, after the sheath 30 has been mounted onto the clamp 22, the outer cover 28 imparts a compressive force onto the sheath 30, causing the channel entrances to be compressed and effectively sealing the control lines 20 within the body of the sheath 30. In this way, the sheath 30 can provide a physical barrier between the control lines 20 and an external environment.

Figure 4:
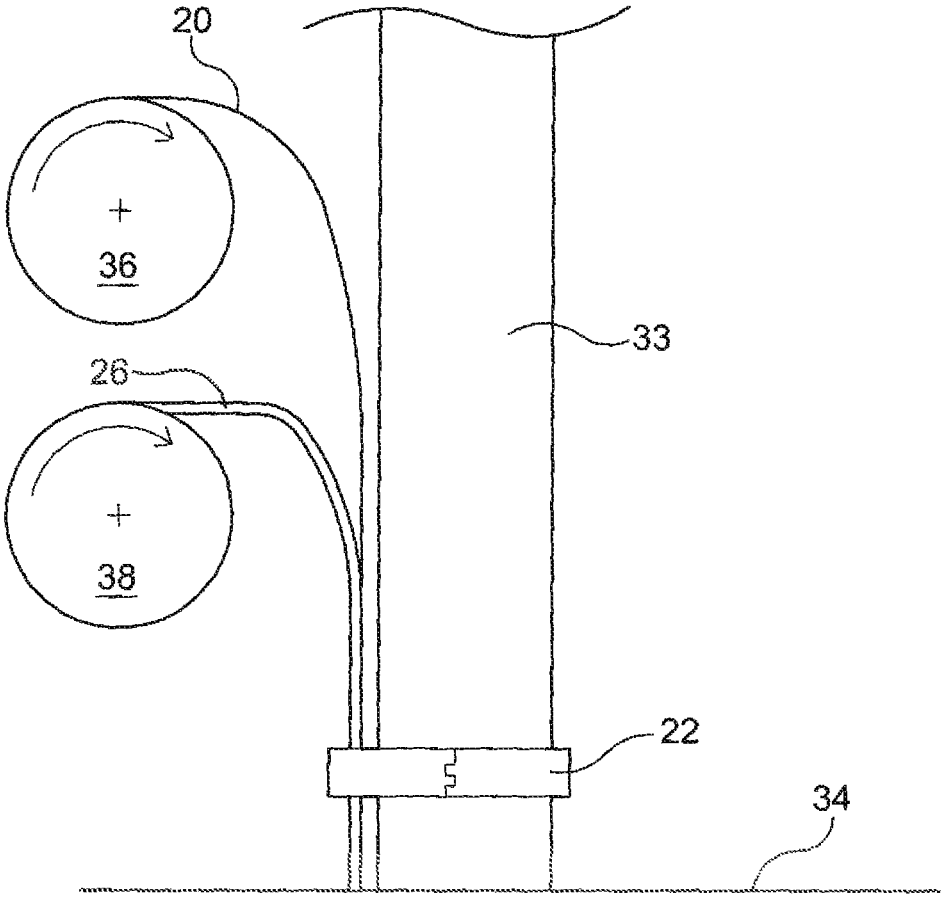
FIG. 4 is a schematic representation of a method of mounting a downhole protection apparatus and control line to a section of tubing string according to an embodiment of the invention.

A method of preparing a section of tubing string 16 for a downhole assembly is shown schematically in FIG. 4.

As shown in FIG. 4, a section of tubing 33 is held in position above a platform 34 e.g. a rig floor. A control line or bundle of control lines 20 are wound around a drum or reel 36. The downhole protection apparatus 26 is provided in rolled form, e.g. in FIG. 4, the downhole protection apparatus 26 is wound around a drum or reel 38. The flexibility of the downhole protection apparatus 26 allows the downhole protection apparatus 26 to be compactly stored and transported on drums, such as reel 38. The provision of the downhole protection apparatus on such a reel also allows for ease of installation onto a tubing string 16, as is described in detail below.

The method comprises mounting a downhole protection apparatus 26 comprising a sheath 30 to a section of tubing 33 and installing, for example by insertion, a control line, or bundle of control lines, 20 into a channel 32 defined by the sheath 30.

In the embodiment shown in FIG. 4, for each section of tubing 33, a section of control line(s) 20 is unwound from the reel 36 and installed, e.g. by insertion, into a channel 32 defined by the sheath 30 of the downhole protection apparatus 26. After insertion of the control line(s) 20 into the sheath 30, the assembly of the sheath and control line(s) is mounted to the section of tubing 33.

As will be appreciated, whilst in this embodiment the control line(s) 20 is installed into the downhole protection apparatus 26 prior to mounting on the section of tubing 33, it is also possible to first mount the downhole protection apparatus to the section of tubing 33 and subsequently install the control line(s) 20, or, alternatively, to carry out the two steps of mounting and installing simultaneously.

In the embodiment shown in FIG. 4, the sheath 30 is mounted and/or attached to an outer surface of the section of tubing 33 such that the entrance of the channel 32 contacts the outer surface of the section of tubing 33. In this embodiment, the step of inserting the control line(s) 20 into the sheath 30 is carried out before, or simultaneously with, the step of mounting the sheath 30 to the section of tubing 33. It will be appreciated that, in other embodiments, the sheath 30 can be attached to the section of tubing 33 such that the entrance of the channel 32 opens to an outside environment. In these embodiments, the step of inserting the control lines(s) 20 is carried out before, after, or simultaneously with the step of mounting the sheath 30 to the section of tubing 33.

During installation of the downhole protection apparatus 26 on a section of tubing 33, reels 36 and 38 are positioned in a parallel line to the section of tubing 33 and adjacent to the section of tubing 33. In this arrangement, as the control lines 20 and the downhole protection apparatus 26 are unwound from reels 36 and 38 respectively, the unwound sections of control line and apparatus 26 align with the length of the section of tubing 33. This facilitates both mounting the apparatus 26 onto the section of tubing 33 and also insertion of the control line 20 into the sheath 30 of the apparatus 26.

Alternatively, the downhole protection apparatus 26 may be provided in the form of discrete elongate sections which can be stacked, for example in pallets or the like, on the rig floor 34 and mounted individually onto the section of tubing 33. In either case, particular lengths of the downhole protection apparatus 26 can be obtained by cutting the apparatus 26 to size prior to mounting on the section of tubing 33. In this way, different lengths of downhole protection apparatus can be mounted to different sections of the tubing string 16 if so desired.

As shown in FIG. 4, after the downhole protection apparatus 26 comprising a control line, or bundle of control lines, 20 has been mounted to a section of tubing 33, the method comprises securing a clamp 22 over the downhole protection apparatus 26 which holds downhole protection apparatus 26 in position on the tubing 16. However, as will appreciated from the foregoing description, the attachment of the downhole protection apparatus 26 to a section of tubing 33 can be effected in many different ways, including by welding, vulcanization, adhesion, cooperating profiles and/or an interference fit with the outside of the clamp 22.

Although not illustrated in FIG. 4, in some embodiments, an outer cover 28 can be mounted onto the downhole protection apparatus 26, before or after the apparatus 26 is mounted onto the section of tubing 33, or the step of mounting the outer cover 28 can be carried out simultaneously with the step of mounting the apparatus 26 onto the section of tubing 33.

After installation of the downhole protection apparatus 26 on a section of tubing 33, the method comprises lowering the section of tubing 33 into a borehole 12.

After mounting and attaching the downhole protection apparatus 26 to a section of tubing 33, the method can further comprise attaching an end of the section of tubing 33 to the end of another section of tubing in order to form a tubing string 16 and then running the tubing string 16 downhole (as shown in FIG. 1).

In some embodiments, the downhole protection apparatus 26 runs continuously along the entire length of the tubing string 16. Alternatively, the downhole protection apparatus 26 is selectively applied to different sections of tubing string 16. For example, the downhole protection apparatus 26 can be applied to sections of tubing string 16 where fracturing and/or perforation is intended to be performed. As described above, the downhole protection apparatus 26 can be cut to a desired length prior to mounting the downhole protection apparatus 26 on a section of tubing 33.

The invention claimed is:

1. A downhole protection apparatus for use in protecting downhole control lines, comprising:

an elongate reelable sheath defining a channel configured to receive a control line, and shield said control line when the apparatus is mounted adjacent a length of tubing of a downhole assembly, the elongate reelable sheath and control line being separately reelable, wherein the elongate reelable sheath defines an entrance to the channel that extends longitudinally along the elongate reelable sheath, the elongate reelable sheath being mountable to an outer surface of a tubing such that the entrance of the channel faces the outer surface of that tubing.

2. The downhole protection apparatus according to claim 1, wherein the elongate reelable sheath comprises or is formed of a resilient and/or an elastic material.

3. The downhole protection apparatus according to claim 1, wherein the elongate reelable sheath comprises rubber.

4. The downhole protection apparatus according to claim 1, wherein the elongate reelable sheath is in a form of a rib configured to extend longitudinally along a length of tubing.

5. The downhole protection apparatus according to claim 1, wherein the elongate reelable sheath comprises at least one of a shock-absorbant material, a lattice structure, a porous structure, a honeycomb-like structure, or is inflatable.

6. The downhole protection apparatus according to claim 1, wherein the elongate reelable sheath comprises a swellable material, the swellable material being swellable in oil or water.

7. The downhole protection apparatus according to claim 1, wherein the elongate reelable sheath comprises a non-swellable material.

8. The downhole protection apparatus according to claim 1, wherein a surface profile of the elongate reelable sheath is configured to engage with an outer surface of a tubing.

9. The downhole protection apparatus according to claim 1, wherein at least one of (1) the channel extends along the same axial direction as the elongate reelable sheath, and (2) the channel is in a form of a slot and is coterminous with the elongate reelable sheath.

10. The downhole protection apparatus according to claim 1, wherein at least one of (1) the elongate reelable sheath is configured such that the channel comprises a variable dimension and (2) material defining the channel is resiliently and elastically deformable.

11. The downhole protection apparatus according to claim 1, further comprising:

an outer cover.

12. The downhole protection apparatus according to claim 11, wherein the outer cover extends continuously along a length of the elongate reelable sheath.

13. The downhole protection apparatus according to claim 11, wherein the outer cover extends discontinuously along a length of the elongate reelable sheath.

14. The downhole protection apparatus according to claim 11, wherein the outer cover is at least one of mountable to a clamping member or integrally formed with a clamping member.

15. The downhole protection apparatus according to claim 1, wherein the elongate reelable sheath is directly attachable to an outer surface of a tubing by at least one of adhesion, fusing, welding, vulcanization, interference, or a cooperating profile.

16. A downhole protection apparatus according to claim 1, wherein the entrance to the channel is located between the channel and a length of tubing.

17. A downhole assembly comprising:

a tubing;

a downhole protection apparatus mounted along a length of the tubing, the downhole protection apparatus including, an elongate reelable sheath defining a channel, the elongate reelable sheath defining an entrance to the channel that extends longitudinally along the elongate reelable sheath, the elongate reelable sheath being mounted to an outer surface of the tubing such that the entrance of the channel faces the outer surface of the tubing; and a control line inserted into the channel;

the elongate reelable sheath and control line being separately reelable.

18. The downhole assembly according to claim 17, wherein the downhole protection apparatus further comprises:

an outer cover.

19. The downhole assembly according to claim 18, wherein the outer cover is mounted to an outer surface of the elongate reelable sheath.

20. The downhole assembly according to claim 17, wherein the downhole assembly further comprises:

at least one of a clamping member or a plurality of clamping members.

21. The downhole assembly according to claim 20, wherein the clamping member is configured to attach the downhole protection apparatus to the tubing.

22. The downhole assembly according to claim 20, wherein an outer cover is at least one of circumscribed by the clamping member, mounted onto the clamping member, or integrally formed with the clamping member.

23. A downhole protection apparatus according to claim 17, wherein the entrance to the channel is located between the channel and a length of tubing.

24. A method for preparing a tubing for a downhole assembly comprising:

mounting a downhole protection apparatus to the tubing, the downhole protection apparatus including, an elongate reelable sheath defining a channel, the elongate reelable sheath defining an entrance to the channel that extends longitudinally along the elongate reelable sheath, the elongate reelable sheath being mounted to an outer surface of the tubing such that the entrance to the channel faces the outer surface of the tubing; and installing a control line into the channel defined by the elongate reelable sheath the elongate reelable sheath and control line being separately reelable.

25. The method for preparing a tubing according to claim 24, wherein the installing the control line occurs at least one of before the mounting, after the mounting, or contemporaneously with the mounting.

26. The method for preparing a tubing according to claim 24, further comprising:

attaching an end of the tubing to an end of another tubing to form a tubing string.

27. The method for preparing a tubing according to claim 24, wherein the downhole protection apparatus is provided in at least one of a rolled form or in a form of discrete elongate sections.

28. The method for preparing a tubing according to claim 24, further comprising:

unrolling the downhole protection apparatus from a reel and mounting the apparatus continuously onto the tubing.

29. The method for preparing a tubing according to claim 24, further comprising:

cutting discrete lengths of downhole protection apparatus from a reel, and mounting the discrete lengths onto the tubing.

30. The method for preparing a tubing according to claim 24, further comprising:

providing the elongate reelable sheath with an outer cover.

31. The method for preparing a tubing according to claim 24, further comprising:

mounting the downhole protection apparatus to a plurality of clamping members, and selectively attaching the plurality of clamping members at discrete points along the length of the tubing.

32. A method for installing a downhole assembly comprising:

mounting a downhole protection apparatus comprising an elongate reelable sheath to a tubing;

installing a control line into a channel defined by the elongate reelable sheath, the elongate reelable sheath defining an entrance to the channel that extends longitudinally along the elongate reelable sheath, the elongate reelable sheath being mounted to an outer surface of the tubing such that the entrance of the channel faces the outer surface of the tubing, the elongate reelable sheath and control line being separately reelable;

attaching an end of the tubing to an end of another tubing to form a tubing string; and running the tubing string downhole.

33. A method for protecting a control line in a downhole environment comprising:

providing a downhole protection apparatus comprising an elongate reelable sheath, the elongate reelable sheath defining a channel and an entrance to the channel, the entrance extending longitudinally along the elongate reelable sheath, the elongate reelable sheath being mountable to an outer surface of a tubing such that the entrance to the channel faces the outer surface of the tubing; and installing the control line into the channel;

the elongate reelable sheath and control line being separately reelable.

* * * * *